US007470116B2

(12) United States Patent
Dantlgraber

(10) Patent No.: US 7,470,116 B2
(45) Date of Patent: Dec. 30, 2008

(54) AXIAL PISTON MACHINE

(75) Inventor: Joerg Dantlgraber, Lohr (DE)

(73) Assignee: Bosch Rexroth AG, Stuttgart (DE)

( * ) Notice: Subject to any disclaimer, the term of this patent is extended or adjusted under 35 U.S.C. 154(b) by 363 days.

(21) Appl. No.: 10/540,113

(22) PCT Filed: Dec. 5, 2003

(86) PCT No.: PCT/DE03/04013

§ 371 (c)(1),
(2), (4) Date: Aug. 23, 2005

(87) PCT Pub. No.: WO2004/055369

PCT Pub. Date: Jul. 1, 2004

(65) Prior Publication Data

US 2006/0120881 A1 Jun. 8, 2006

(30) Foreign Application Priority Data

Dec. 18, 2002 (DE) ..... 102 59 311

(51) Int. Cl.
*F04B 1/12* (2006.01)
*F04B 27/08* (2006.01)

(52) U.S. Cl. ..... 417/269; 91/472; 92/71; 92/72; 92/169

(58) Field of Classification Search ..... 417/269; 91/472, 499, 500, 504; 92/71, 72, 169
See application file for complete search history.

(56) References Cited

U.S. PATENT DOCUMENTS

| | | | | |
|---|---|---|---|---|
| 2,968,286 | A | 1/1961 | Wiggermann | |
| 3,052,098 | A * | 9/1962 | Heinrich | 60/492 |
| 3,584,543 | A * | 6/1971 | Herman | 91/486 |
| 3,648,567 | A | 3/1972 | Clark | |
| 3,722,372 | A * | 3/1973 | Freese | 91/504 |
| 4,075,933 | A * | 2/1978 | Stephens | 91/506 |
| 4,207,779 | A * | 6/1980 | Papst | 74/579 R |
| 4,382,399 | A * | 5/1983 | Lotter | 91/486 |
| 4,617,853 | A * | 10/1986 | Wagenseil et al. | 91/505 |
| 4,945,817 | A * | 8/1990 | Scholl | 91/505 |
| 5,112,197 | A * | 5/1992 | Swain et al. | 417/222.2 |
| 5,304,043 | A * | 4/1994 | Shilling | 417/269 |
| 5,538,401 | A * | 7/1996 | Schaffner et al. | 417/222.1 |
| 5,636,561 | A * | 6/1997 | Pecorari | 91/499 |
| 5,794,514 | A * | 8/1998 | Pecorari | 92/71 |
| 2004/0126245 | A1 * | 7/2004 | Folsom et al. | 417/269 |
| 2005/0201879 | A1 * | 9/2005 | Achten | 417/521 |
| 2006/0222516 | A1 * | 10/2006 | Achten | 417/269 |

FOREIGN PATENT DOCUMENTS

| | | |
|---|---|---|
| WO | WO 81/03677 | 12/1981 |
| WO | WO 94/10443 | 5/1994 |

* cited by examiner

*Primary Examiner*—Devon C Kramer
*Assistant Examiner*—Amene S Bayou
(74) *Attorney, Agent, or Firm*—Oliff & Berridge, PLC

(57) ABSTRACT

What is disclosed is an axial-piston machine having at least one swash plate and one cylinder drum supported thereon, which includes a multiplicity of cylinder sleeves. To the cylinder sleeves a row of pistons is associated which is connected with a shaft. In accordance with the invention, the cylinder sleeves are articulatedly mounted in the cylinder drum.

17 Claims, 3 Drawing Sheets

AXIAL PISTON MACHINE

The invention concerns an axial-piston machine.

Such an axial-piston machine as known, e.g., from U.S. Pat. No. 2,968,286, includes a multiplicity of pistons approximately arranged in axial directions which are guided in a cylinder drum. The cylinder drum is on its end side supported on a swash plate, the inclination angle of which determines the stroke of the pistons. In order to minimize the forces manifesting in the axial direction, in the solution disclosed in U.S. Pat. No. 2,968,286 there are provided two rows of pistons having opposite orientations, so that the axial-piston machine correspondingly is formed with two cylinder drums and two swash plates. The pistons are connected with a shaft acting, depending on the design of the axial-piston machine, as an input or output shaft. Owing to the oblique arrangement of the cylinder drum, rotation of the pistons about the shaft axis and the corresponding rotational movement of the cylinder drum brings about a transversal motion between pistons and cylinder drum. This transversal motion is compensated in the known solution in that the piston are mounted via a universal joint (ball joint) in a drive flange connected in rotation with the shaft.

In WO 81/03677 A1, a similar solution with oppositely directed rows of pistons is disclosed, wherein the pistons are connected in pairs through the intermediary of a connection rod. This connection rod is mounted in the drive flange via a ball joint and with play, and also permits to compensate the transversal motions.

In WO 94/10443 A1 a generic solution is disclosed, wherein the pistons are rigidly connected with the drive flange and extend in parallel with the axial direction (shaft). Compensation of the transversal motions is effected through a configuration of the cylinders with curved peripheral surfaces. A similar solution is moreover disclosed in U.S. Pat. No. 5,636,561.

The above described solutions suffer from the common drawback that a considerable expense in terms of device technology is necessary for compensating the transversal motions.

In U.S. Pat. No. 3,648,567 an axial-piston machine having only one row of pistons is disclosed, which is connected in rotation with the drive flange. The pistons protruding in parallel with the axial direction plunge into sleeves of the cylinder drum, which are slidingly guided on the swash plate.

It is the drawback of such a solution that the contact surfaces between the sleeves and the swash plate must be machined with utmost precision. Moreover under unfavorable operating conditions, striae may form in the swash plate or in the sleeves owing to sliding of the sleeves. Particularly under rapid load changes, the sleeves may tilt, so that there is a risk of damage, and performance losses have to be accepted In contrast, the invention is based on the objective of furnishing an axial-piston machine that permits a compensation of transversal motions at minimum expense in terms of device technology.

This object is achieved through an axial-piston machine having the features of claim 1.

In accordance with the invention, the axial-piston machine includes a cylinder drum having a multiplicity of cylinder sleeves directly or indirectly supported on a swash plate. This support is effected, in accordance with the invention, by means of a joint configured such that the transversal motions are compensated by a tilting movement of the cylinder sleeves. Due to the articulated mounting of the cylinder sleeves relative to the swash plate, the risk of a formation of striae or other furrows is minimal, so that the lifetime of the axial-piston machine can be extended substantially in comparison with conventional solutions.

In accordance with the invention it is preferred if the joint has the form of a universal joint or ball joint that allows swivelling of the cylinder sleeves in the desired range to all sides.

In a particularly preferred practical example, the ball joint includes a joint pin extending through a bottom of the cylinder sleeve and forming the ball joint jointly with an inner peripheral range of the cylinder sleeve.

In a particularly simple variant, this joint pin has the form of a spherical shell, on the spherical head of which a seal contacting the inner peripheral wall of the cylinder sleeve is formed.

In an alternative variant, the joint is formed in kinematic reversal by a pin axially protruding from the bottom of the cylinder sleeve, the free end portion of which plunges into a reception of the swash plate or of a component contacting the swash plate, for example of a drive member, and is sealingly mounted there.

Functional safety of the axial-piston machine of the invention is improved if the cylinder sleeves are biased in a direction towards the swash plate.

In a variant of the invention which may be manufactured with particular simplicity, such spring bias is established by means of a spring encompassing the cylinder sleeve which acts on a foot-side, radially projecting support rim of the cylinder sleeve.

In a practical example, the bottom of the cylinder sleeve is designed to be spherical, so that it rolls on this spherical range while tilting.

The cylinder sleeves are preferably guided on a drive member of the cylinder drum which is supported by an end surface on the swash plate and connected in rotation with the input or output shaft. Here it is preferred if the drive member includes a drive member disc having a flange part, on the annular end surface of which facing away from the swash plate the cylinder sleeves are supported.

For the case that the cylinder sleeves are mounted through the intermediary of joint pins, kidney-shaped recesses may be provided in the flange part, wherein these joint pins are inserted. The parts of the joint pins plunging into the kidney-shaped recesses may then be positively immobilized by beading.

The joint pins, or the pins employed in the kinematic reversal, preferably are hollow so that pressure medium may be guided through them.

In order to minimize the forces manifesting in an axial direction, the axial-piston machine may be designed with two rows of pistons having an opposite orientation, two cylinder drums, and two swash plates.

In one solution in accordance with the invention it is preferred if the pistons are designed in pairs as double pistons and connected in rotation with a drive flange of the shaft. The portions of the pistons that plunge into the cylinder sleeve have a conical configuration expanding towards seals.

The construction in accordance with the invention may in a particularly advantageous manner be employed with axial piston pumps where the shaft serves as a drive shaft for driving the pistons and the cylinder drumn.

Other advantageous developments of the invention are subject matters of further subclaims.

In the following, a preferred practical example of the invention is explained in more detail by means of schematic drawings, wherein.

Figure 1:
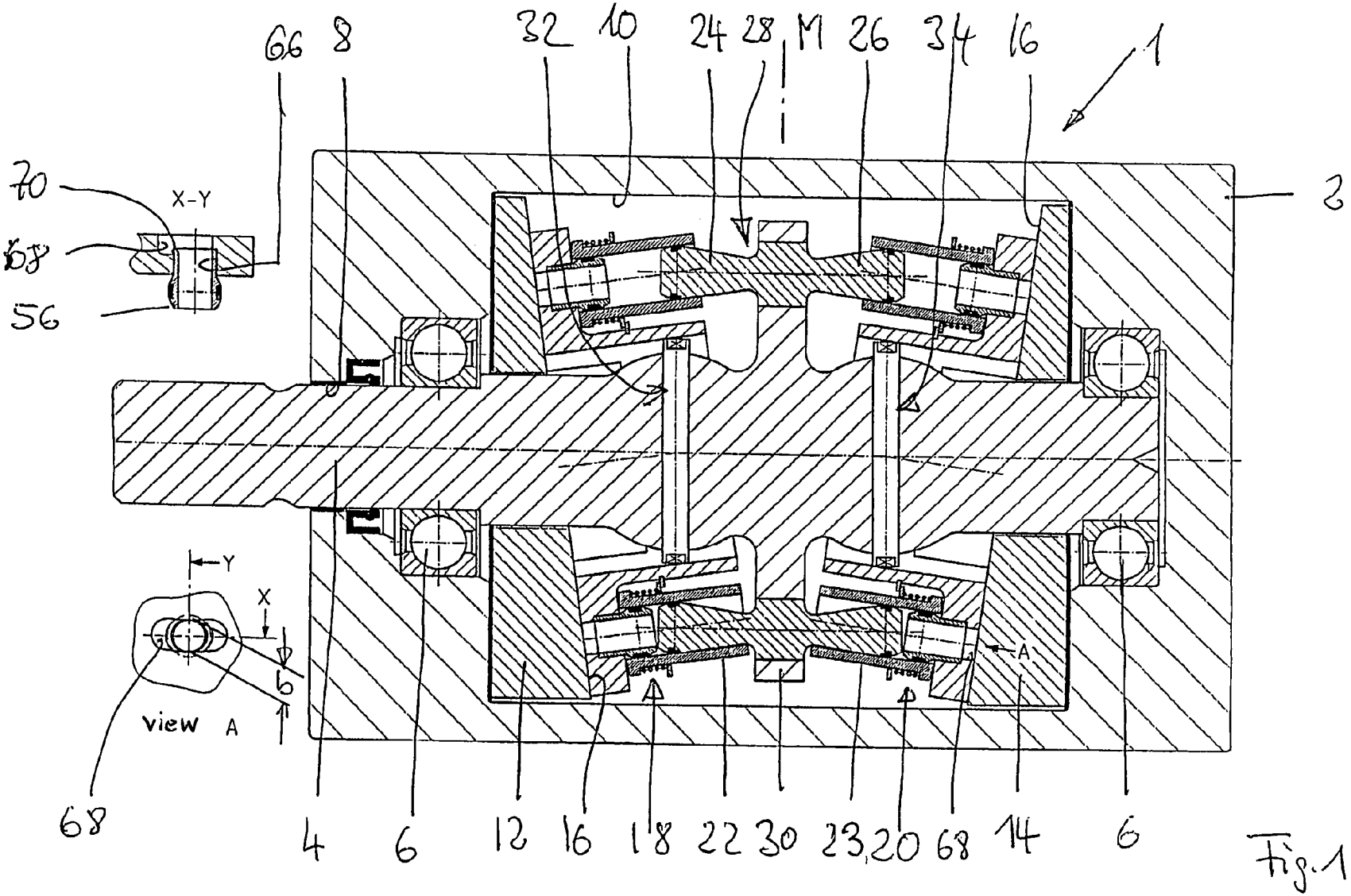
FIG. 1 is a sectional view of a first practical example of an axial piston pump in accordance with the invention.

FIG. 1 shows a longitudinal sectional view of an axial piston pump 1. The latter includes a pump housing 2 on which a tank and pressure port (not represented) are formed. In the pump housing 2 a drive shaft 4 is rotatably mounted through the intermediary of a bearing assembly 6. A free end portion of the drive shaft 4 projecting from the pump housing 2 is connected with a drive motor (not represented).

An internal bore 8 of the pump housing 2, which receives the drive shaft 4, is radially expanded into a pump chamber 10 wherein the two swash plates 12, 14 are mounted while secured against relative rotation. The two swash plates 12, 14 each have a support surface 16 extending obliquely to the vertical shown in FIG. 1, on each of which a cylinder drum 18, 20 is supported. As will be explained in more detail hereinbelow, each cylinder drum 18, 20 includes a multiplicity of cylinder sleeves 22, 23 into each of which one piston 24, 26 plunges. In accordance with the representation of FIG. 1, the swash plates 12, 14, and correspondingly the cylinder drums 18, 20 are arranged symmetrically relative to the vertically extending center axis M. The two pistons 24, 26 are each formed by the end portions of a double piston 28 inserted in a radially projecting drive flange 30 of the drive shaft 4 so as to be secured against relative rotation. Mounting of the cylinder drums 18, 20 is achieved with the aid of self-aligning bearings 32, 34 admitting the tumbling movement occurring during the rotation of the shaft 4 due to the oblique position of the cylinder drums 18, 20. Further details of the arrangement are explained by referring to the detail representation of the cylinder drum 20 in FIG. 2.

In accordance with the invention, the cylinder drum 20 includes a drive member 36 which is supported via the joint 34 on the drive shaft 4 and is slidingly supported through a radially expanded flange part 40 on the obliquely inclined support surface 16 of the swash plate 14. The self-aligning bearing 34 engages an internal bore of a hub-shaped protrusion 38 of the drive member 36.

On an annular end face 42 of the flange part 40 removed from the support surface 16, the cylinder sleeves 23 of the cylinder drum 20 having a regular distribution across the periphery are supported. They have on the foot side a radially protruding, peripheral support rim 44, the bottom surface 46 of which contacts the annular end face 42 and has a shperical shape, so that the cylinder sleeve 23 is allowed to perform a tilting movement in any direction, wherein a respective defined contact surface is ensured by the spherical bottom surface 46.

A tensioning spring 48 attacks at the support rim 44, whereby the cylinder sleeve 23 is biased into its contact position against the annular end face 42. The tensioning spring 48 in turn is supported on a support ring 58 which encompasses the outer periphery of the cylinder sleeves 23 and the hub-shaped protrusion 38 and is supported in the axial direction through the intermediary of support means 52. The cylinder sleeve 23 has a cylinder bore 54 into which the piston forming the end portion of the double piston 28 plunges.

Radial support of the cylinder sleeve 23 is achieved by means of a spherical shell 56 having the form of a joint pin, which plunges with a spherical head 58 into the cylinder bore 54 and sealingly contacts the inner peripheral wall of the cylinder bore 54 through a seal 60. The spherical shell 56 is inserted into a reception 62 of the flange part 40, to be described in more detail hereinbelow.

The spherical shell 56 has a bore 64 opening into a through opening 66 of the flange part 40, so that pressure medium may flow from the cylinder chamber defined by cylinder sleeve 23 and piston 26 to the swash plate 14 and in the opposite direction. In the latter, connection passages (not shown) are formed, which establish—depending on the rotational position (inner, outer dead center) of the cylinder drum 18—a connection with the tank port or pressure port so as to guide pressure medium to the cylinder chamber, or to conduct pressure medium subjected to high pressure towards a consumer.

Details of the reception 62 are explained by referring to the views "A" and "X-Y" in FIG. 1.

In accordance with the view "X-Y", the reception 62 has a bore portion 66 into which the part of the spherical shell 56 extending away from the head 58 is inserted. The bore portion 66 opens into a through opening 68 expanding into a kidney shape and extending along a radial segment of the one partial circle along which the cylinder sleeves 23 are arranged. The axial length of the part of the spherical shell 56 inserted into the bore portion 66 is selected such that an end portion 70 protrudes into the through opening 68. Fixation of the spherical shell 56 is then effected by beading these end portions protruding into the kidney-shaped protrusion 68 (see section X-Y in FIG. 1).

In other words, these kidney-shaped through openings 68 provide space enabling a positive connection of the spherical shell 56 with the drive member 36.

The width b of the kidney-shaped through opening 68 corresponds to the diameter of the bore portion 66.

Figure 2:
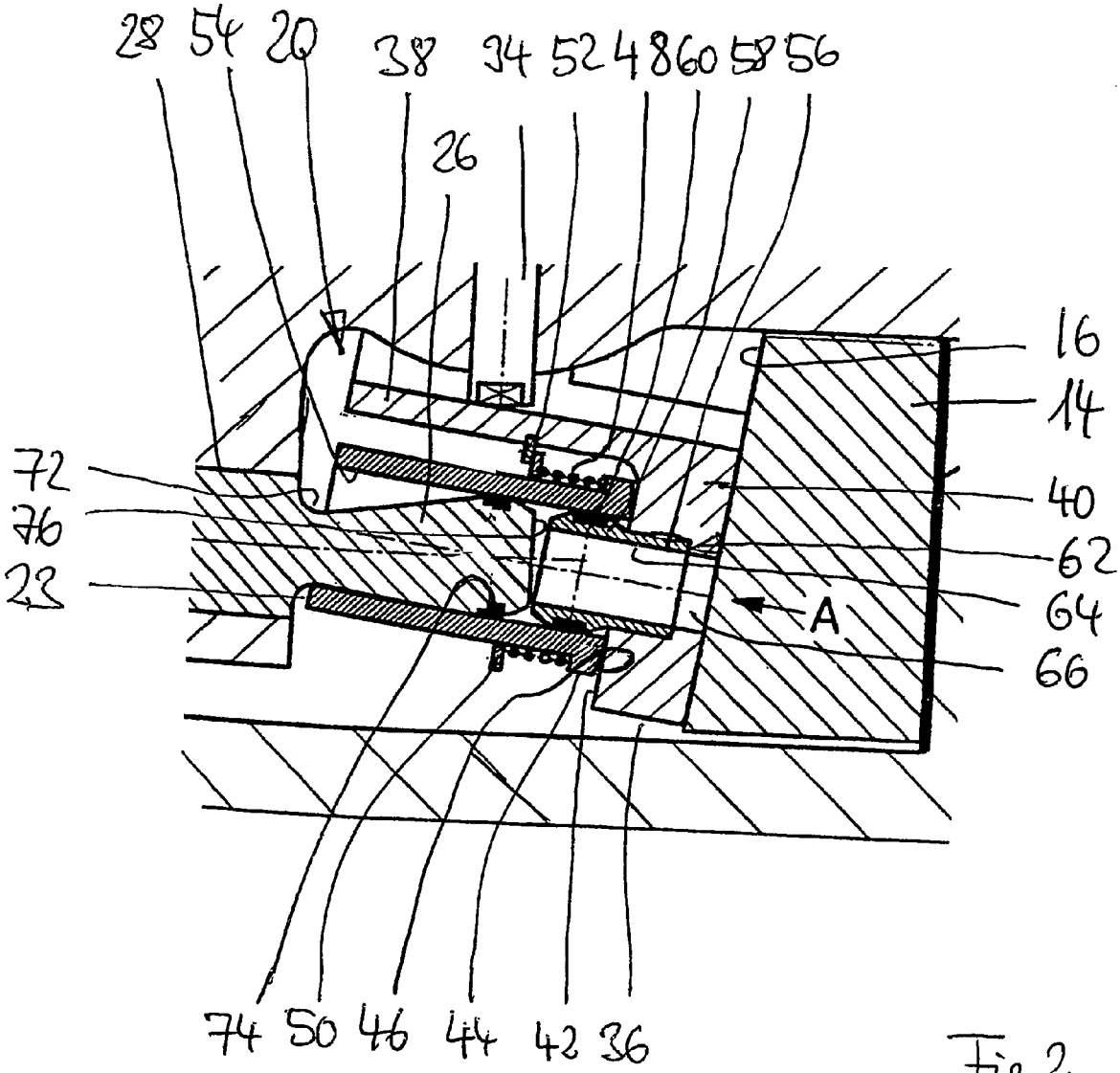
FIG. 2 is a detail of the practical example of FIG. 1.

In accordance with the representation in FIG. 2, the piston 26 has an approximately cone-shaped configuration with its diameter conically expanding from a constriction 72 towards a foot-side piston ring 74 acting as a seal, and again spherically tapering from the piston ring 74 into an end face 76.

The cone angle is selected such that that the peripheral surfaces of the piston 26 in the two dead centers (see FIG. 1 top: outer dead center; FIG. 1 bottom: inner dead center) do not collide with the inner peripheral surfaces of the cylinder sleeves 22, 23 while rectilinearly contacting them, in which end positions sealing via the piston ring 74 must equally be ensured.

The geometry of the arrangement of the invention is selected such that the cylinder sleeves 22, 23 each are aligned in the inner dead center, vertical with regard to the end face 16 of the swash plate, so that the tilting angle in the inner dead center, i.e., during pressure build-up, is minimal and thus a symmetrical support of the cylinder sleeves 22, 23 is ensured.

Figure 3:
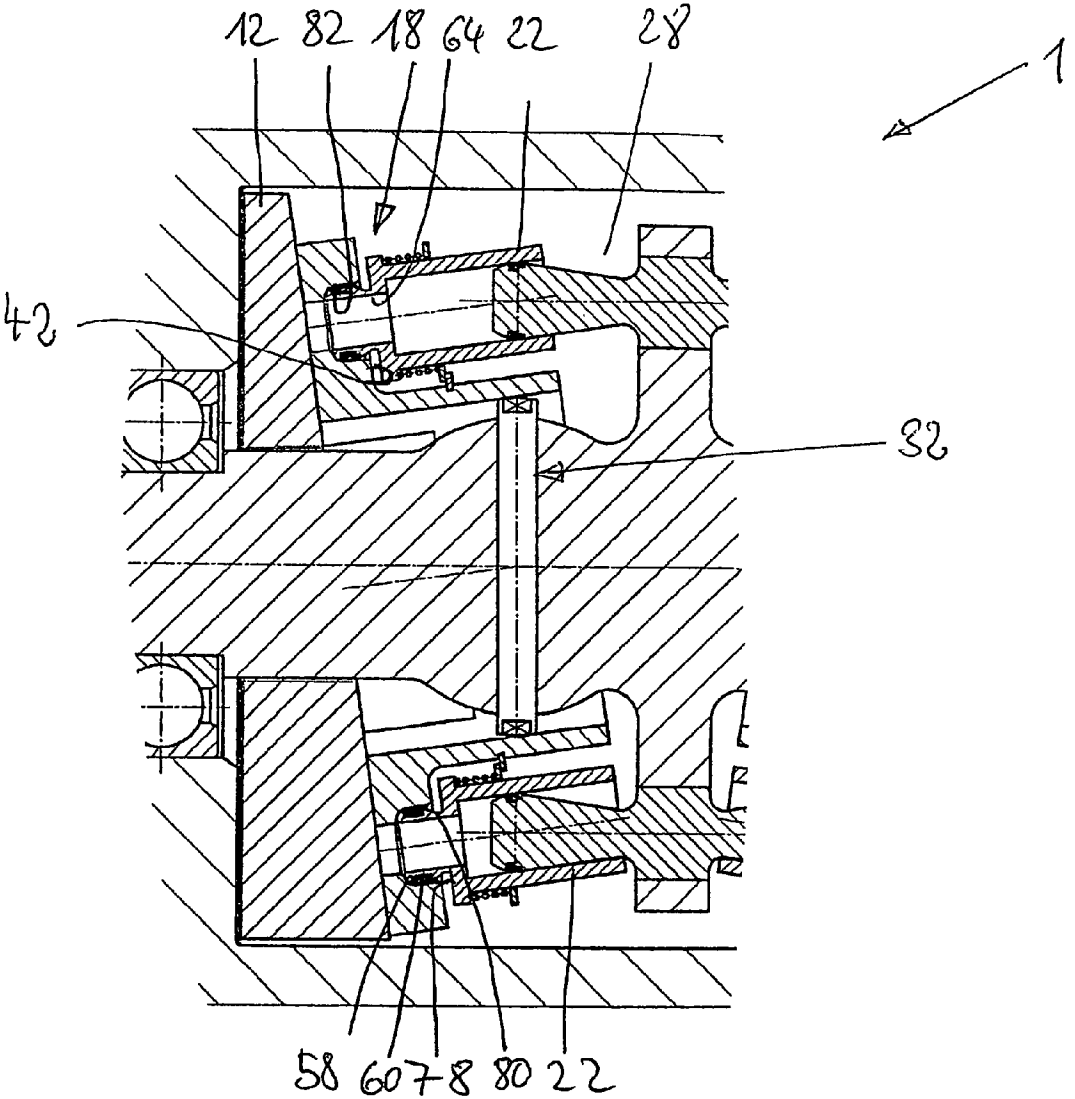
FIG. 3 is a detail of another practical example of an axial piston pump.

FIG. 3 shows a partial view of another practical example of an axial piston pump 1, wherein merely one cylinder drum 18 is represented. The further cylinder drum 20 is designed accordingly. The practical example represented in FIG. 3 differs from the above described practical example substantially in mounting of the cylinder sleeves 22. The construction of the double pistons 28, of the swash plates 12, 14, and the basic structure of the drive member 36 are substantially identical, so that hereinbelow only the different components shall be discussed.

In the practical example represented in FIG. 3, the cylinder sleeve 22 has a planarly shaped bottom surface 78 from which a pin 80 projects in an axial direction towards the swash plate 12. The pin 80 has at its free end portion a head 58 with a seal 60, the construction of which substantially conforms with the one of the above described practical example. The head 58 plunges into a bearing reception 82 formed as a ball cup and is biased into this engagement position through the tensioning spring 48, in which position the spherical portions of the head 58 and of the bearing reception 82 are in contact with each other and thus form a universal joint.

The end face 78 is arranged at a spacing from the adjacent annular end face 42 of the drive member 36, so that the sleeve may tilt in order to compensate the transversal motion about the universal joint (82, 58).

For the rest, this practical example corresponds to the above described one, so that further explanations are not required.

In the represented practical example a swash plate 12, 14 is represented with a constant angle of inclination. This angle of inclination may, of course, also be variable in order to vary the stroke.

The above described construction may be employed in an axial piston engine, or also in a hydraulic transformer having an axial construction. In principle the represented articulated mount of the cylinder sleeves 22 may also be employed in variants having only one swash plate and one cylinder drum.

What is disclosed is an axial-piston machine having at least one swash plate and one cylinder drum supported thereon, which includes a multiplicity of cylinder sleeves. To the cylinder sleeves a row of pistons is associated which is connected with a shaft. In accordance with the invention, the cylinder sleeves are articulatedly mounted in the cylinder drum.

LIST OF REFERENCE SYMBOLS

1 axial piston pump
2 pump housing
4 drive shaft
6 bearing
8 internal bore
10 pump chamber
12 swash plate
14 swash plate
16 support surface
18 cylinder drum
20 cylinder drum
22, 23 cylinder sleeve
24 piston
26 piston
28 double piston
30 drive flange
32 self-aligning bearing
34 self-aligning bearing
36 drive member
38 protrusion
40 flange part
42 annular end face
44 support rim
40 bottom surface
48 tensioning spring
50 support ring
52 support means
54 cylinder bore
56 spherical shell
58 head
60 seal
62 reception
64 bore
66 bore portion
68 through opening
70 end portion
72 constriction
74 piston ring
76 end face
78 bottom surface
80 pin
82 bearing reception

The invention claimed is:

1. Axial-piston machine including at least one swash plate on which a cylinder drum is supported, wherein pistons are guided that are in operative connection with a shaft, wherein the axis of rotation of the cylinder drum is inclined relative to the axis of rotation of the pistons, and wherein the cylinder drum has a multiplicity of cylinder sleeves indirectly or directly supported on the swash plate, characterized in that each cylinder sleeve is longitudinally pivotally mounted through the intermediary of a joint.

2. Axial-piston machine in accordance with claim 1, wherein the joint is a ball joint.

3. Axial-piston machine in accordance with claim 1, wherein a joint pin extends through a bottom of the cylinder sleeve and forms the joint jointly with an inner peripheral range of the cylinder sleeve.

4. Axial-piston machine in accordance with claim 3, wherein the joint pin is a spherical shell, on the spherical head of which a seal contacting the inner peripheral wall of the cylinder sleeve is formed.

5. Axial-piston machine in accordance with claim 1, wherein a joint pin of the joint is formed by a pin which axially projects from the bottom of the cylinder sleeves and carries a seal.

6. Axial-piston machine in accordance with claim 1, wherein the cylinder sleeves are biased into a position of contact.

7. Axial-piston machine in accordance with claim 6, wherein the cylinder sleeves have on the foot side a radially projecting support rim on which a tensioning spring attacks.

8. Axial-piston machine in accordance with claim 3, wherein each cylinder sleeve has a spherical bottom surface.

9. Axial-piston machine in accordance with claim 1, wherein the cylinder sleeves are guided in a drive member of the cylinder drums, which drive member is supported through one end face on the swash plate and is connected in rotation with the shaft so as to admit a tumbling motion.

10. Axial-piston machine in accordance with claim 8, wherein the drive member has a drive member disc with a flange part, at the annular end face of which the cylinder sleeves are supported.

11. Axial-piston machine in accordance with claim 10, wherein through openings are arranged in the flange parts, approximately in axial alignment with the cylinder sleeve, in each of which one joint pin is immobilized.

12. Axial-piston machine in accordance with claim 11, wherein the through opening is formed in a kidney shape in portions thereof, and the joint pin is positively immobilized by beading the ranges adjacent these kidney-shaped portions.

13. Axial-piston machine in accordance with claim 3, wherein a bore extends through the joint pin or a pin.

14. Axial-piston machine in accordance with claim 5, wherein a spherical head of the pin is mounted in a bearing reception of the flange part.

15. Axial-piston machine in accordance with claim 1, wherein two rows of oppositely oriented pistons, to each of which a cylinder drum and a swash plate are associated.

16. Axial-piston machine in accordance with claim 1, wherein the piston has the form of a double piston with two oppositely oriented pistons that are connected in rotation with the shaft, and the portions of which plunging into the cylinder sleeves conically expand from a constriction towards the piston rings.

17. Axial-piston machine in accordance with claim 1, wherein it is realized as an axial piston pump.

* * * * *